United States Patent [19]

Counterman

[11] Patent Number: 4,574,865

[45] Date of Patent: Mar. 11, 1986

[54] METHOD OF MAKING A FINNED CAST RECUPERATOR TUBE

[75] Inventor: Wayne S. Counterman, Wellsville, N.Y.

[73] Assignee: The Air Preheater Company, Inc., Wellsville, N.Y.

[21] Appl. No.: 668,119

[22] Filed: Nov. 5, 1984

[51] Int. Cl.[4] ..... B22D 19/00

[52] U.S. Cl. ..... 164/11; 164/9; 164/98; 164/108; 164/110; 164/112

[58] Field of Search ..... 164/9, 10, 11, 98, 108, 164/109, 110, 112

[56] References Cited

U.S. PATENT DOCUMENTS

| | | | |
|---|---|---|---|
| 1,131,743 | 3/1915 | Simms | 164/11 |
| 1,449,637 | 3/1923 | Tremolada | 164/109 |
| 1,925,967 | 9/1933 | Olson | 164/109 X |
| 1,938,707 | 12/1933 | Mann | 164/9 |
| 2,391,615 | 12/1945 | Caron | 164/10 |

*Primary Examiner*—Nicholas P. Godici
*Assistant Examiner*—J. Reed Batten, Jr.
*Attorney, Agent, or Firm*—William W. Habelt

[57] ABSTRACT

A hollow metallic envelope 10 of a finned cast recuperator tube is cast with preformed interior fins 12 and exterior fins 16 integral therewith. A sand core 30 is formed about the preformed interior fins 12 with portions of the fins 12 protruding outwardly from the sand core, and a sand mold 40 is formed to a cavity for receiving the sand core 30 with the preformed exterior fins 16 embedded in the sand mold with portions of the fins 16 protruding therefrom into the cavity. The sand core 30 is placed into the sand mold 40 in spaced relationship therewith so as to provide a clearance space 50 between the sand core 30 and sand mold 40 into which the portions of the interior fins 12 and exterior fins 16 extend. Molten metal is poured into the space 50 which upon cooling solidifies to form the envelope 10 with the interior fins 12 and exterior fins 16 fused integrally therewith.

4 Claims, 7 Drawing Figures

METHOD OF MAKING A FINNED CAST RECUPERATOR TUBE

BACKGROUND OF THE INVENTION

The present invention relates to a method of making a metallic recuperative heat exchanger of the tubular type and, more particularly, to a method of casting a hollow metallic recuperative heat exchanger envelope having fins extending at least from the interior surface of the envelope into the cavity defined by the envelope and, if desired, from the exterior of the envelope.

Because of its resistance to corrosion and erosion, and because of its superior heat transmission capabilities, and also because of its tendency to resist the deposition of particulate matter thereon, cast iron has long been a preferred constituent for the manufacture of heat exchangers particularly for application in transferring heat from a hot flue gas from the combustion of a fossil fuel to preheat air being supplied for the combustion of the fossil fuel. A typical cast recuperator tube, such as shown in U.S. Pat. No. 4,417,615, comprises a hollow elongated metallic envelope having a somewhat rectangular cross-section and defining therein an interior flow cavity through which one of the heat exchange fluids, typically the fluid to be heated, flows while the other heat exchange fluid, particularly the heating fluid, flows over the exterior of the envelope in cross-flow to the fluid passing through the interior of the envelope. It is common to provide fins on both the interior surface and the exterior surface of the heat exchange tube so as to enhance heat transfer between the two fluids.

In U.S. Pat. No. 4,417,615, an integral cast recuperator tube is formed in a two-step casting operation with a sand core being formed with spaces cut therein for the interior fins of the envelope and a split mold wherein spaces are also cut for the exterior fins of the heat exchange tubes. First, the sand core is placed in the lower half of the sand mold and molten metal poured into the cavity therebetween to form the lower half of the heat exchange envelope and then the upper half of the sand mold is placed over the sand core and metal poured into the cavity therebetween to form the upper half of the envelope with the upper and lower halves of the envelope being fused together during the casting of the upper envelope to form a integral one-piece tubular finned heat exchange envelope. Unfortunately, while such casting process produces an acceptable recuperator tubes, the manufacturing process continues to be excessively time consuming and expensive.

SUMMARY OF THE INVENTION

Therefore, the present invention is directed to an improved method of manufacturing a hollow metallic heat exchange envelope of the type having at least interior fins and, preferably, also exterior fins. In the method of the present invention, the interior and exterior fins are preformed to whatever shaped desired and pretreated, if desired, to provide a surface enhancement to improve heat transfer. To form a hollow metallic envelope of the finned cast recuperator tube, a sand core is formed about the finned surface with portions of the finned surface protruding outwardly from the sand core. The sand core is also contoured about its exterior surface to provide the desired interior shape of a hollow metallic envelope. A sand mold is formed defining a cavity adapted to receive the sand core and contoured to provide a desired exterior surface shape for the metallic envelope. The sand core is placed within the sand mold in spaced relationship therewith so as to provide a clearance space between the sand mold and sand core into which the portions of the finned surface protruding outwardly from the sand core extend. A quantity of molten metal is then poured into the clearance space between the sand core and the sand mold which, upon cooling, solidifies to form the hollow metallic envelope. During the casting process, the finned surface becomes fused with the molten metal poured into the clearance space. In this manner, the finned surface becomes integral with the cast metallic envelope of the recuperator tube.

The finned surface may comprise a plurality of metallic strips of whatever desired shape which are placed on edge in a jig at spaced intervals to extend outwardly from both sides of the jig. This jig is then filled with sand so that when the jig is removed, a sand core will be formed with the metallic strips embedded in the sand core with portions of each of the plurality of metallic strips protruding outwardly from the sand core. Alternatively, the finned surface may comprise a continuous metallic sheet folded to provide a series of undulations. This continuous undulated sheet is embedded in sand so that a portion of each of the undulations protrudes outwardly from the sand forming the sand core.

Further, if exterior fins are desired on the exterior surface of the recuperator tube envelope, the fins may be preformed and embedded in the sand mold in a manner similar to that described hereinbefore with respect to the interior fins which are embedded in the sand core. A portion of each of the exterior fins embedded in the sand mold protrudes outwardly therefrom into the clearance space between the sand core and the sand mold so that when molten metal is poured into the clearance space, the preformed exterior fins will become fused with the cast metallic envelope.

DESCRIPTION OF THE PREFERRED EMBODIMENT

Figure 1:
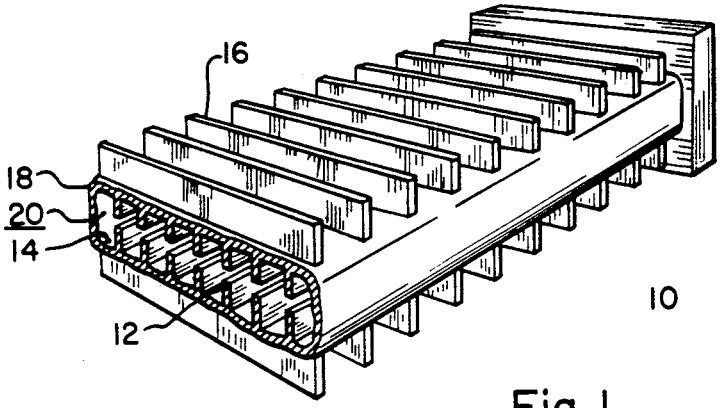
FIG. 1 shows a perspective view of one embodiment of a tubular envelope for a recuperative heat exchanger made in accordance with the present invention.
Figure 6:
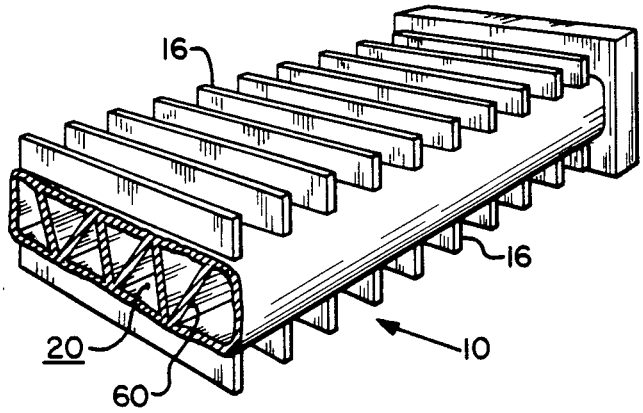
FIG. 6 is a perspective view of an alternate embodiment of a tubular envelope for a recuperative heat exchanger made in accordance with the present invention.

The present invention comprises a method of making a hollow metallic envelope 10 for a recuperative heat exchanger such as shown in FIGS. 1 and 6 wherein a plurality of fins 12 or 60 extend from the inner surface 14 of the envelope 10 into the interior flow cavity 20 defined therein and a plurality of fins 16 extend outwardly from the exterior surface 18 of the envelope 10. Recuperative heat exchangers of this type are typically utilized to exchange heat from a hot flue gas flowing over the exterior of the recuperator tube with combustion air flowing through the interior flow cavity 20 of the envelope 10 of the recuperator tube.

In accordance with the present invention, the interior fins 12 or 60 and the exterior fins 16, if desired, may be preformed in any desired shape prior to the casting of the tubular envelope 10 but still be bonded integrally with the envelope 10 during the casting process. In the prior art wherein spaces were provided in the sand core and the sand mold into which molten metal was poured during the casting process to form the fins, the configuration of the fins was extremely limited to very simple designs. Additionally, it was not possible to provide a surface treatment to the fins, particularly interior fins, as the fins were formed during the casting process. With preformed fins, it is possible to enhance the surface of the fins by any of a number of well known techniques such as roughening the surface or perforating the surface, or providing undulations in the surface of the fins in order to improve the heat transfer characteristics of the fins.

Figure 2:
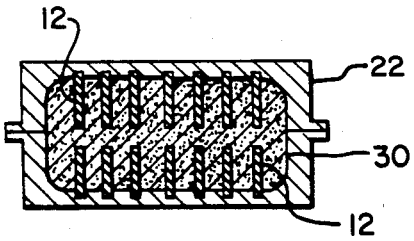
FIG. 2 is a cross-sectional end view of a sand core enclosed in a jig illustrating the formation of a sand core about preformed interior fins.

To form a cast recuperator tube of the type shown in FIG. 1 in accordance with the method of the present invention, the sand core 30 is formed about the interior finned surface means, which in this case comprises a plurality of metallic strips 12, with a portion of each of the interior fins 12 protruding outwardly from the sand core 30. The sand core is contoured about its exterior surface to provide the desired interior shape of the hollow metallic envelope wall. As illustrated in FIG. 2, to form the sand core 30, the plurality of metallic strips 12 are placed on edge in a jig 22 at spaced intervals so as to extend inwardly from the two halves of the jig into the cavity enclosed by the jig. The strips 12 are disposed so as to be in alignment with the direction of gas flow through the interior of cavity 20 of the envelope 10. Sand is then packed into the cavity of the jig about the metallic strips 12 to form the contours of the interior wall of the envelope 10. The sand is packed about the metallic strips 12 so that, upon removal of the jig 22, a portion of each of the plurality of metallic strips 12 protrudes outwardly from the resulting sand core 30.

Figure 3:
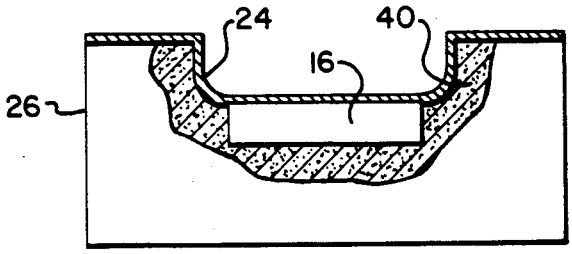
FIG. 3 is a cross-sectional end view of a sand mold enclosed in a jig and shell illustrating the formation of a sand mold about preformed exterior fins.
Figure 4:
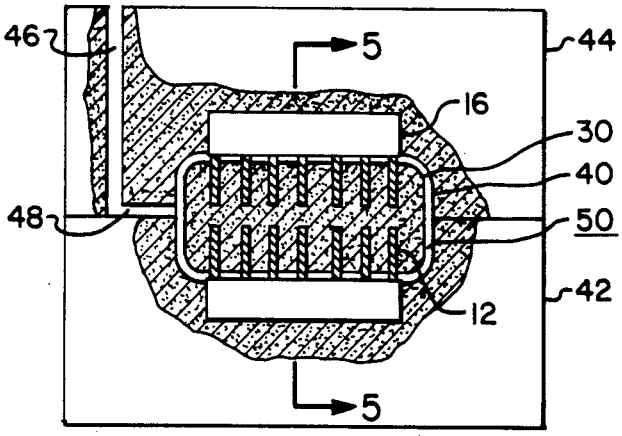
FIG. 4 is a cross-sectional end view of a sand core enclosed within a sand mold and assembled for casting an integral finned tubular envelope for a recuperative heat exchanger made in accordance with the present invention.
Figure 5:
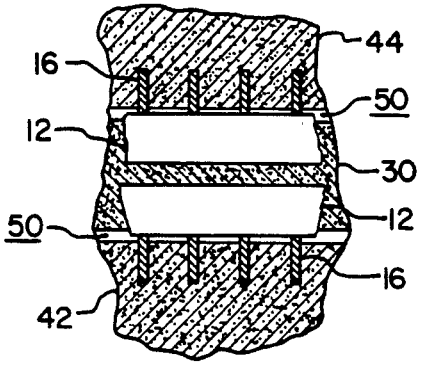
FIG. 5 is a sectional side elevational view taken along the line 5—5 of FIG. 4.

A sand mold 40 is also formed to define a cavity adapted to receive the sand core 30. The surface of the sand mold cavity is contoured to provide the desired exterior shape for the metallic envelope 10. If it is desired that the exterior of the envelope 10 of the recuperator tube be equipped with exterior fin surface means such as the fins 16 as seen in FIGS. 1 and 6, they can be cast as a portion of the metallic envelope 10 or be preformed and embedded in the sand mold 40 such that a portion of each of the exterior fins 16 embedded within the sand mold protrudes outwardly from the sand mold 40 into the cavity defined by the sand mold 40 for receiving the sand core 30. To form a sand mold 40 with preformed exterior fins embedded therein, a plurality of metallic strips 16 are placed on edge in a jig 24 at spaced intervals transverse to the longitudinal axis of the mold 40 as shown in FIG. 3. Sand is then packed about the jig 24 in the support shell 26 to form half of the sand mold 40 with a portion of each of the strips 16 protruding outwardly therefrom into the mold cavity. The second half of the mold 40 is similarly formed. The lower half 42 and upper half 44 of the sand mold 40 are adapted to mate with each other and enclose the sand core 30 therein as shown in FIGS. 4 and 5. Additionally, the sand mold 40 is equipped with suitable sprues 46 and gates 48 into which molten metal is poured and directed into the sand mold during the casting process.

Having formed the sand core 30 and the sand mold 40, the sand core 30 is placed within the sand mold 40 in spaced relationship therewith as illustrated in FIGS. 4 and 5. In practice, the casting is preferably carried out in a single pour, but a double pour casting operation may also be used. In a single pour casting, the sand core 30 is placed in the lower half 42 of the sand mold 40 and then the upper half 44 of the sand mold 40 is placed over the sand core 30 and mated with the lower half 42 of the sand mold 40 so as to provide a continuous clearance space 50 therebetween which defines the envelope 10 of the cast recuperator tube. A quantity of molten metal is then poured into the clearance space 50 which upon cooling solidifies to form the hollow metallic envelope 10.

In a double pour casting, the sand core 30 is placed in the lower half 42 of the sand mold 40 so as to provide a continuous clearance space 50 between the sand core 30 and the lower half 42 of the sand mold 40 which defines the lower half of the envelope 10 of the cast recuperator tube. A first quantity of molten metal is then poured into this clearance space which upon cooling solidifes to form the lower half of the envelope 10. The upper half 44 of the sand mold 40 is then placed over the sand core 30 and mated with the lower half 42 of the sand mold 40 so as to provide a continuous clearance space between the sand core 30 and the upper half 44 of the sand mold 40 which defines the upper half of the envelope 10. A second quantity of molten metal is then poured into this clearance space which upon cooling solidifies to form the upper half of the envelope 10 which becomes fused during the casting process to the lower half of the envelope 10 so as to form an integral one-piece hollow metallic envelope.

In accordance with the present invention, a portion of each of the interior fins 12 and the exterior fins 16 protrude, respectively, from the sand core 30 and the sand mold 40 into the clearance space 50 formed between the sand core 30 and the sand mold 40 when the sand core is placed within the sand mold as best illustrated in FIGS. 4 and 5. As the molten metal is poured into the clearance space 50 during the casting process, the portions of the fins 12 and 16 protruding into the clearance space 50 are thermally bonded with the hollow metallic envelope 10 formed upon the cooling of the molten metal filling the clearance space 50. In this manner, the finned surface can be preformed to any shape and configuration desired while still being integrally formed with the envelope 10 during the casting process.

The sand comprising the sand core 30 is preferably mixed with a binder that is adapted to break down when exposed to the high temperature of the molten casting metal after it has been poured into the clearance space 50 between the core 30 and the mold 40. After cooling and solidification of the metal that forms the envelope 10, the particulate sand of the core 30 is readily removed from the newly formed envelope 10 with fins 12 and 16 integral therewith.

Figure 7:
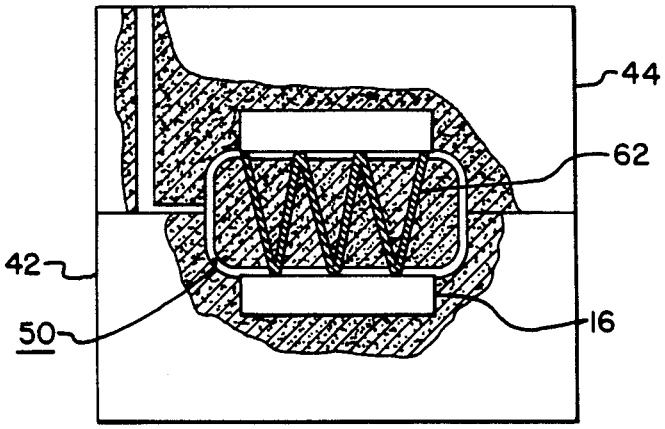
FIG. 7 is a cross-sectional end view of a sand core enclosed in a sand mold and assembled for casting the finned tubular envelope of the recuperative heat exchanger of FIG. 6.

In the alternate embodiment of the recuperator tube shown in FIG. 6, the finned surface means 60 disposed in the interior flow cavity 20 of the envelope 10 of FIG. 6 is formed from a continuous metallic sheet 62 folded to provide a series of undulations as best seen in FIG. 7. The sand core 30 is formed about the continuous metallic sheet 62 such that the end portions of the undulations of the continuous sheet 62 protrude outwardly from the sand core 30 whose exterior surface is again contoured to provide the desired interior shape of the envelope 10. When the sand mold 30 of FIG. 7 is enclosed in the sand mold 40 in spaced relationship therewith, a clearance space 50 is again provided between the sand core 30 and the sand mold 40 into which the end portions of each of the undulations in the continuous metallic sheet 62 protrude. Upon pouring a quantity of molten metal into the clearance space 50, the end portions of each of the undulations in the continuous sheet 62 protruding into the cavity 50 are thermally bonded with the hollow metallic envelope 10 formed by the solidification of the metal in the clearance space 50 and become integral therewith.

Accordingly, the present invention provides a method of manufacturing a finned cast recuperator tube wherein the fins may be preformed but also be integrally fused with the envelope of the heat exchange tube. It is to be understood that the method of the present invention is not limited to the exact procedures shown and described hereinbefore as obvious modifications will be apparent to those skilled in the art. For example, it is not necessary that both the interior and exterior fins of the cast recuperator tube be formed in accordance with the present invention. That is, it is within the scope of the present invention to form only the interior fins on the envelope of the cast recuperator tube in accordance with the method presented herein while forming the exterior fins in accordance with well-known prior art techniques. Additionally, other casting techniques and processes may be adapted by those skilled in the casting art to carry out the method of the present operation.

I claim:

1. A method of making a hollow metallic envelope having a desired interior surface shape enclosing an interior flow cavity and fin surface means extending into the interior cavity from the interior surface of the envelope, said method comprising the steps of:

a. forming a sand core about said fin surface means with portions of the said fin surface means protruding outwardly from the sand core, the sand core contoured about its exterior surface to provide the desired interior shape of the hollow metallic envelope;

b. forming a sand mold defining a cavity adapted to receive the sand core and contoured to provide a desired exterior surface shape for the metallic envelope;

c. placing the sand core within the sand mold in spaced relationship therewith so as to provide a clearance space therebetween into which the portions of said fin surface means protruding outwardly from the sand core extend; and d. pouring a quantity of molten metal into the clearance space which upon cooling solidifies to form the hollow metallic envelope with said fin surface means being fused integrally therewith.

2. A method of making a hollow metallic envelope as recited in claim 1 wherein said fin surface means comprises a plurality of metallic strips and the step of forming a sand core about said fin surface means comprises:

a. placing said plurality of metallic strips on edge in a jig at spaced intervals so as to extend outwardly from both sides on the jig; and b. embedding the jig in sand so that a portion of each of said plurality of metallic strips protrudes outwardly from the sand thereby forming the sand core.

3. A method of making a hollow metallic envelope as recited in claim 1 wherein said fin surface means comprises a continuous metallic sheet folded to provide a series of undulations and the step of forming a sand core about said fin surface means comprises embedding the continuous undulated sheet in sand so that a portion of each of said undulations protrudes outwardly from the sand thereby forming the sand core.

4. A method of making a hollow metallic envelope having a desired interior surface shape enclosing an interior flow cavity and first fin surface means extending into the interior cavity from the interior surface of the envelope, and a desired exterior surface shape and second fin surface means extending outwardly therefrom, said method comprising the steps of:

a. forming a sand core about said first fin surface means with portions of said first fin surface means protruding outwardly from the sand core, the sand core contoured about its exterior surface to provide the desired interior shape of the hollow metallic envelope;

b. forming a sand mold defining a cavity adapted to receive the sand core and contoured to provide the desired exterior surface shape of the hollow metallic envelope, said second fin surface means embedded with the sand mold with portions of said second fin surface means protruding from the sand mold, inwardly into the cavity thereof;

c. placing the sand core within the sand mold in spaced relationship therewith so as to provide a clearance space therebetween into which the portions of the first fin surface means protruding outwardly from the sand core and the portions of the second fin surface means protruding inwardly from the sand mold extend; and d. pouring a quantity of molten metal into the clearance space which upon cooling solidifies to form the hollow metallic envelope with the first and second fin surface means being fused integrally therewith.

* * * * *